US005860840A

United States Patent [19]

Boatman et al.

[11] Patent Number: 5,860,840

[45] Date of Patent: Jan. 19, 1999

[54] DISCONNECTABLE TURRET MOORING SYSTEM UTILIZING A SPIDER BUOY

[75] Inventors: L. Terry Boatman; Ron L. Kelm, both of Houston; Brent A. Salyer, Cypress; Arun S. Duggal, Houston, all of Tex.

[73] Assignee: FMC Corporation, Chicago, Ill.

[21] Appl. No.: 862,593

[22] Filed: May 23, 1997

Related U.S. Application Data

[60] Provisional application No. 60/023,069, Aug. 2, 1996.

[51] Int. Cl.[6] ..... B63B 22/02

[52] U.S. Cl. ..... 441/5; 114/230

[58] Field of Search ..... 114/230; 441/3–5; 141/69

[56] References Cited

U.S. PATENT DOCUMENTS

| | | | |
|---|---|---|---|
| 4,490,121 | 12/1984 | Coppens et al. | 441/5 |
| 4,604,961 | 8/1986 | Ortloff et al. | 441/4 |
| 4,606,727 | 8/1986 | Koenig et al. | 441/5 |
| 4,765,378 | 8/1988 | Engelskirchen et al. | 441/5 |
| 4,892,495 | 1/1990 | Svensen | 441/5 |
| 5,651,708 | 7/1997 | Borseth | 441/5 |

*Primary Examiner*—Jesus D. Sotelo
*Attorney, Agent, or Firm*—Bush, Riddle, & Jackson L.L.P.

[57] ABSTRACT

A disconnectable vessel mooring system including a storage vessel (10) with a turret (32) mounted therein so that the vessel is free to weathervane about an anchored turret. A spider buoy (44) in a docked position is received within the turret (32) with the upper part of the buoy at a position above the sea water level to permit dry servicing of the buoy (44). Anchor legs (68) in the docked position are secured to the turret (32) by securing means (71). Guide tubes (72) on the outer surface of the buoy (44) receive the anchor legs (68) therein for limited longitudinal travel. Selected anchor legs (68) may be disconnected from the buoy (44) when detached from the turret (32) for lowering onto the sea floor to reduce the weight of anchor legs supported by the buoy (44).

11 Claims, 2 Drawing Sheets

DISCONNECTABLE TURRET MOORING SYSTEM UTILIZING A SPIDER BUOY

BACKGROUND OF THE INVENTION

1. Reference to Related Provisional Application

This application claims the benefit of Provisional Application Ser. No. 60/023,069 filed Aug. 2, 1996.

2. Field of the Invention

This invention relates to a disconnectable vessel mooring system in which the vessel includes a structure for mounting a turret about which the vessel may weathervane when the turret is anchored to the sea floor by a spider buoy releasably connected to the turret. The spider buoy is buoyant and is anchored to the sea floor by a plurality of spaced mooring lines.

3. Description of the Prior Art

Reference is made to U.S. Pat. No. 5,306,186 dated Apr. 26, 1994, the entire disclosure of which is incorporated within this application as a written description for all purposes. As shown in the '86 patent, the spider buoy has a plurality of anchor legs comprising chains which are connected to the sea floor by anchors such as piles or drag embedment anchors. The anchor legs in the docked position of the buoy remain connected directly to the buoy. Anchoring forces are transmitted to the buoy. The spider buoy which is also referred to as a "mooring buoy" or "mooring element" is pulled tightly against the bottom of the turret below sea level by a mooring chain. The spider buoy is detachably latched to the turret. Thus, the turret is substantially fixed to the sea floor with the spider buoy docked against the turret. Any connections of the spider buoy to the turret, as disclosed in the '86 patent, must be made below the sea level.

Drilling and production operations are being performed at increased water depths and in even more harsh environments that include the potential passage of large icebergs. In instances where the water depth is great or the anchor legs are heavy to meet other design considerations, the design of the spider buoy and its connecting hardware becomes increasingly complex and expensive.

A spider buoy supports risers which extend to wells on the sea floor for the transport of hydrocarbon product to storage areas in the vessel. Connections of product lines on the turret are made to the risers in the buoy. Because the buoy is normally docked on the lower end of the turret, the buoy is below the level of sea water within the moon pool or vertical opening in the hull of the vessel which receives the turret. As a result, any coupling or connection of product lines from the turret to the risers of the buoy is performed beneath the sea level.

Mooring lines for the buoy are commonly formed of metal chains which may be of great weight, particularly at large water depths over thirty-five hundred (3500) feet, for example. Thus, a spider buoy when detached from a turret and supporting a plurality of heavy mooring lines or chains may submerge to a depth greater than desired. Otherwise the buoy must have great buoyancy to support the anchor legs. It is often uneconomical to provide a buoy of sufficient size and buoyancy to support the anchor legs or mooring lines when the buoy is detached from the turret and submerges to a suitable water depth for equilibrium.

A marker or spotter buoy floating on the surface of the sea water is usually connected to the submerged spider buoy to indicate the location of the submerged spider buoy. A small retrieval line extends from the marker buoy to the submerged spider buoy. A tanker or storage vessel locates the marker buoy and retrieves the spider buoy from its submerged position. The spider buoy is submerged at a depth low enough so that passing ships do not interfere. A suitable submerged depth is generally between thirty-five (35) and one hundred and fifty (150) meters. Thus, it is desirable to provide a disconnectable mooring system so that the spider buoy when disconnected from the turret is submerged to a desired depth range.

SUMMARY OF THE INVENTION

The present invention is embodied in a disconnectable turret mooring system utilizing a spider buoy releasably connected to the turret and secured to the sea floor by a plurality of catenary mooring lines anchored to the sea floor. The turret has a lower well or recess to receive the spider buoy therein at a position above sea level when the buoy is docked and detachably connected to the turret. A lower annular end portion of the turret about the recess extends alongside the spider buoy. A platform on the turret adjacent the upper end of the docked buoy permits a workman to service the buoy including connecting and disconnecting various riser lines. The anchor legs or lines (mooring lines) in the docked position of the spider buoy are supported both vertically and horizontally by the turret in order to remove the anchoring forces and weight of the anchor lines from the spider buoy. The anchoring forces from the mooring lines thus bypass the buoy when it is in a docked position on the turret. Additionally, relatively small light weight leader chains are attached to the upper ends of the anchor legs for pulling the anchor legs upwardly for connection to the turret upon docking of the spider buoy on the turret. Suitable winch assemblies lift the upper ends of the anchor legs to a raised position for anchoring to the turret. The leader chains are also used for lowering the anchor legs back onto the spider buoy for detachment of the buoy from the turret for deployment. Depending on the length and weight of the anchor legs, it is necessary to have as few as three main anchor legs connected directly to the spider buoy when detached from the turret to support the buoy beneath the sea surface at an equilibrium depth. The small lightweight leader chains for the remaining anchor legs which are not secured directly to the buoy lower such remaining legs onto the sea floor to remove their weight from the spider buoy when deployed at an equilibrium depth.

The lower end portion of the turret about the spider buoy engages the catenary anchor chains at a location below the spider buoy in a manner to redirect the horizontal loads of the anchor chains into vertical loads. Vertical loads of the anchor chain, when connected to the turret, are opposed by the turret above the buoy. Suitable guide tubes or hawse pipes secured to the outer periphery of the spider buoy permit the anchor chains to be raised and lowered relative to the turret. When in a docked position within the recessed lower end portion of the turret, the upper end of the spider buoy is above the draft line or sea water level of the vessel in order to permit dry access to the spider buoy for docking of the spider buoy to the turret and for connection of risers on the spider buoy to product lines on the turret.

A principal object of this invention is to provide a disconnectable vessel mooring system having a detachable spider buoy docked on a turret at a height above the sea level to permit servicing of the buoy and coupling of product lines to risers on the buoy from a dry area.

A further object of this invention is to provide such a disconnectable vessel mooring system in which the anchor legs or chains for the spider buoy are anchored to the turret when the buoy is docked on the turret so that anchoring forces exerted by the anchor legs bypass the buoy and are opposed directly by the turret.

Another object of this invention is to provide a disconnectable vessel mooring system having a spider buoy for a turret connected to anchor legs anchored to the sea floor and an arrangement for reducing the weight of anchor legs acting on the buoy upon release of the buoy from the turret so that the spider buoy may have a buoyancy less than that required to support all of the anchor legs at a predetermined submerged depth.

BRIEF DESCRIPTION OF THE DRAWINGS

The objects, advantages and features of the invention will become more apparent by reference to the drawings which are appended hereto and wherein an illustrative embodiment of the invention is shown, of which.

DESCRIPTION OF THE INVENTION

Figure 1:
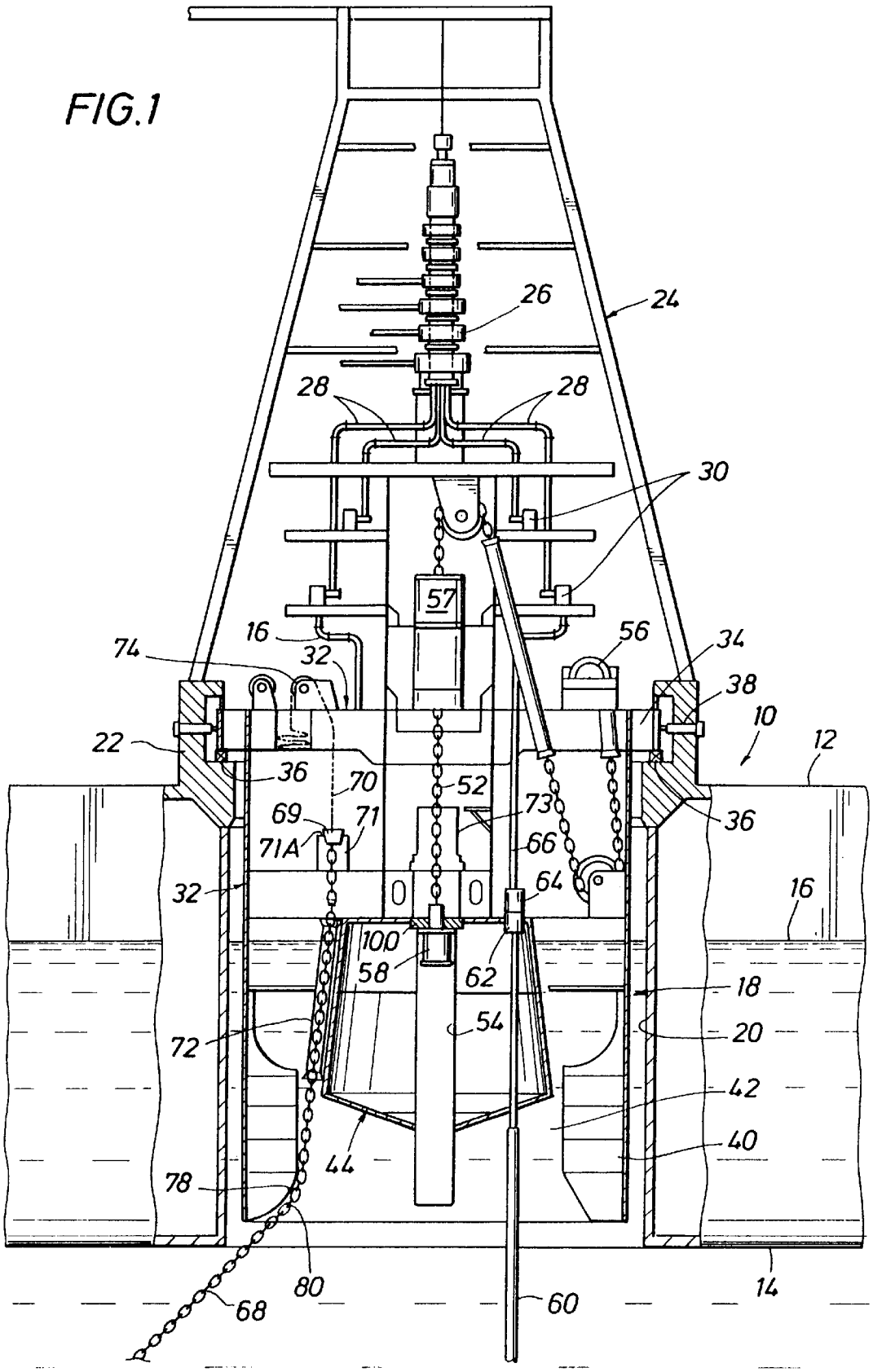
FIG. 1 is a fragmented longitudinal section of a vessel having an opening therein for receiving a turret where the turret has a lower recess for receiving a spider buoy.

As shown in the drawings, the bow of a vessel is indicated generally at 10 and has a deck 12. The bottom of the hull is shown at 14. Sea level for a fully loaded (100% draft) vessel 10 is indicated at 16. An opening or moon pool in vessel 10 is shown at 18 and defines an inner peripheral surface 20. An upwardly extending supporting deck portion 22 is provided adjacent opening 18. A fully enclosed turret housing shown generally at 24 is secured to the upper end of deck portion 22. A swivel stack 26 is supported on turret housing 24. Product lines 28 from manifolds 30 extend to swivel stack 26 for distribution to predetermined holds in vessel 10. Providing a fully enclosed housing 24 increases its rigidity thereby permitting the use of taller swivel stacks.

Figure 2:
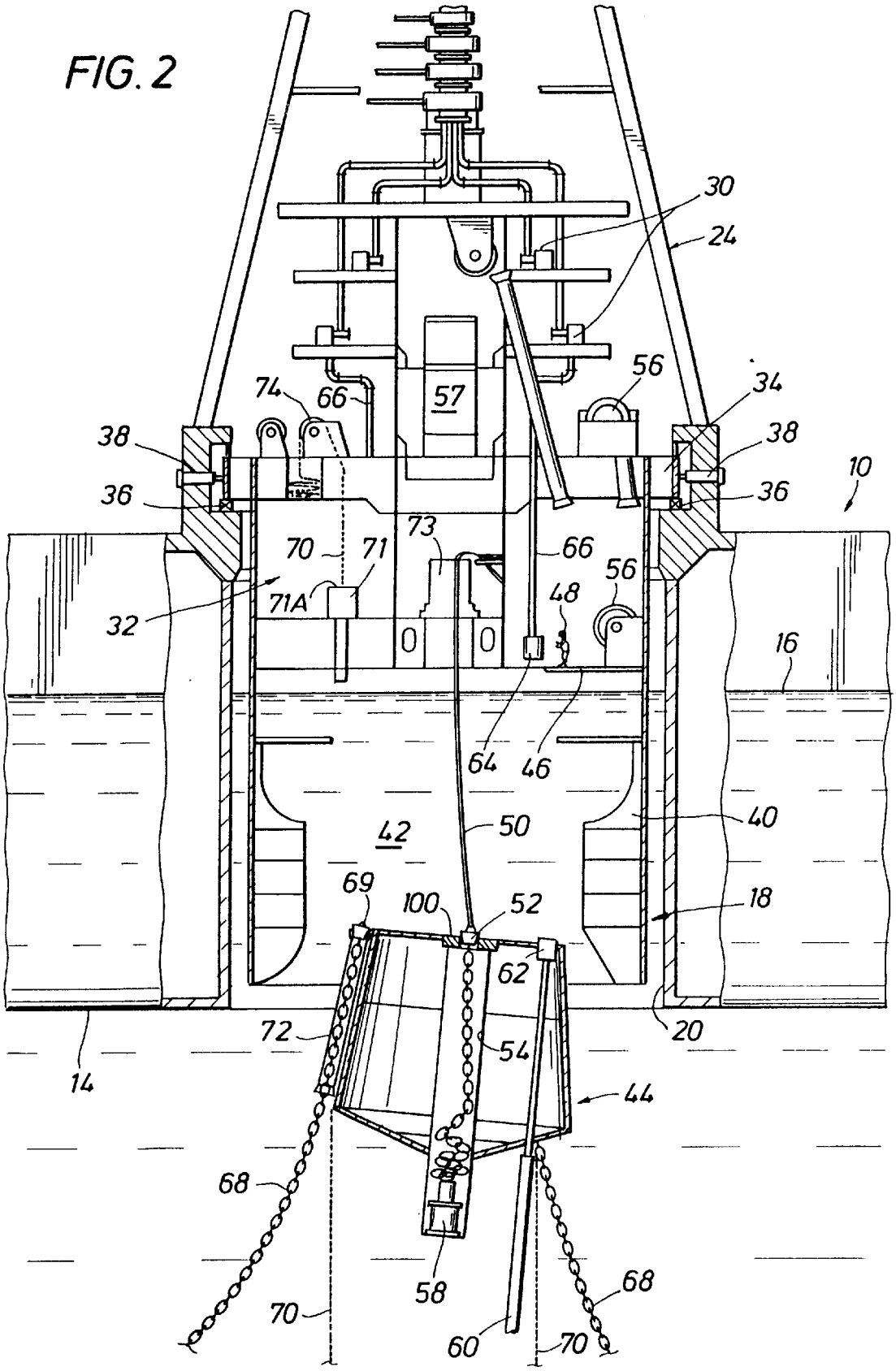
FIG. 2 is a fragmented longitudinal section similar to FIG. 1 but shows the spider buoy released from the turret for deployment at a submerged location.

A turret 32 is mounted within opening 18 and has a laterally extending overhanging upper portion 34. Axial thrust bearings 36 and side radial bearings 38 support turret 32 on vessel 10 for relative rotation so that vessel 10 may weathervane about turret 32. Turret 32 supports manifolds 30 at its upper end. A generally cylindrical lower end portion or fender 40 of turret 32 has an open lower end which defines a generally cylindrical well or recess 42. Recess 42 provides a channel for entry and exit of spider buoy 44 as shown in FIG. 2. Recess 42 extends upwardly beyond the sea level 16 to provide a dry working area for workmen to service spider buoy 44 to assist in docking and deployment of spider buoy 44, and to connect risers to manifold piping. A platform 46 extends into recess 42 to support a workman 48 as shown in FIG. 2. A retrieval line 50 for spider buoy 44 is connected at its lower end to the upper end of a pull-in chain 52 mounted within a pocket 54 of spider buoy 44. The upper end of retrieval line 50 is connected to a marker buoy (not shown) capable of floating on the sea surface upon release of spider buoy 44 for indicating the location of spider buoy 44 when it is submerged.

A retainer plug member 58 is secured to the lower end of chain 52. It abuts a stop 100 adjacent the upper end of spider buoy 44 to maintain chain 52 in a taut relation for docking of buoy 44. Mooring chain 52 is lifted and tensioned by a jack assembly 57, and winch assembly 56. For further details reference is made to aforementioned U.S. Pat. No. 5,306,186, columns 8–10.

Risers 60, which extend to wells or manifolds on the sea floor, are carried by spider buoy 44. They include a coupling 62 which is connected to a mating coupling 64 on turret 32. Mating couplings 62 and 64 are well known in the art and may be purchased from M.I.B. International, Limited, of Coventry, England or FMC Corporation of Houston, Tex. Workman 48 standing on platform 46 above sea level 16 connects couplings 62 and 64 upon docking of spider buoy 44. The connection is facilitated because it is performed above the sea, not in the sea water. Suitable piping 66 extends to manifolds 30 and swivel stack 26 from mating couplings 62, 64 for the supply of product to holds in vessel 10.

Spider buoy 44 is formed so that it has buoyancy. It may include polyurethane foam material or it may have steel enclosed air chambers.

Twelve anchor legs are preferably provided which comprise anchor chains 68 designed and arranged in an array spaced from each other. Fewer than twelve or more than twelve anchor legs may be provided. The upper ends of chains 68 are arranged and designed for releasable connection to leader lines 70 which may be lightweight chains 70. The chains 68 may be pulled upwardly by leader lines 70 when docked by suitable winch assemblies 74 as shown in FIG. 1. Chains 68 are mounted within guide tubes or hawse pipes 72 secured to the outer periphery of spider buoy 44. Chains 68 are arranged and designed to pass within tubes 72. Chain securing means 71 includes a hole 71A for accepting a chain stopper 69 which secures the upper end of chains 68 while in the docked position. Chain stopper 69 is preferably a conical plug of two halves which are manually clamped about a link of chain 68. Stoppers of this type are well know in the art and need not be described further. Reference is made to U.S. Pat. No. 4,841,895 dated Jun. 27, 1989 for further details.

Leader chains 70 are disconnected from anchor chains 68 after re-connection or docking is complete. Lightweight leader lines 70 are removably connected to the upper ends of anchor chains 68 by a so-called "Baldt" link bolted to anchor chains 68. When the buoy 44 is to be disconnected from turret 32 and vessel 10, the connector 58 is unlatched, and stoppers 69 are removed from the top of anchor chains 68. Lines 70 are lowered and stoppers 69 (FIG. 2) may be positioned on chains 68 adjacent the upper ends of guide tubes 72 to maintain chains 68 within guide tubes 72 if it is desired to prevent certain pre-selected anchor chains 68 from passing through guide tube 72. When a stopper 69 is removed from an anchor chain 68, anchor chain 68 may pass downwardly through guide tube 72 and lowered onto the sea bottom. Anchor chain 68 may have a width of six (6) inches for example, and leader line 70 may have a width of two (2) inches for example. Stopper 69 may be positioned on anchor chain 68 by workmen at a location above chain securing means 71 for contact with chain securing means 71 in the docked position of spider buoy 44 (FIG. 1) so that mooring forces are transferred to turret 32, not to spider buoy 44.

In order for the spider buoy 44 to submerge to the correct depth after disconnection from the vessel, it is necessary to reduce the weight of anchor lines 68 on the spider buoy 44. This is accomplished by lowering pre-selected anchor chains 68 on lightweight leader chains 70 supported from spider buoy 44. For example, it may be necessary to have only three anchor chains 68 supported from buoy 44 with the remaining anchor chains 68 resting on the seabed with leader chains 70 being supported by spider buoy 44. For this purpose, when spider buoy 44 is disconnected from vessel 10, stoppers 69 are removed from all mooring chains 68 at chain securing means 71 and the pre-selected chains 68 are lowered downwardly by leader lines 70. Three pre-selected chains 68, for example, have stoppers 69 applied to mooring chains 68 above guide tubes 72; stoppers 69 on the pre-selected chains 68 engage guide tubes 72 to prevent further downward travel of the associated chains 68. The remaining anchor chains 68 are lowered through associated guide tubes 72 on leader lines 70 to a desired depth or to the sea floor. The tension in pre-selected anchor chains 68 and length of leader lines 70 connected to lowered anchor chains 68 are predetermined so that spider buoy 44 submerges to a predetermined depth after disconnection from the vessel.

For reconnection or docking of spider buoy 44, mooring line 50 is hauled in until retrieval chain 52 enters chain jack 57. Retrieval chain 52 is then hauled in until spider buoy 44 is in tight contact with turret 32, at which point tension connector 73 is energized to provide pre-tension and locking of the spider buoy 44 to the turret 32. A suitable connector is described in U.S. Pat. No. 5,306,186 as described above. Preselected anchor chains 68 are then raised from upper guide tubes 72 on spider buoy 44 and positioned on chain securing means 71 with stoppers 69. Remaining anchor chains 68 without stoppers 69 are hauled in with leader chains 70 and stored in a suitable location. Mating couplers 62 and 64 are connected for risers 60.

A lower portion 78 of chains 68 as shown in FIG. 1 contacts a curved or beveled surface 80 of lower turret fender 40. Vertical forces exerted by anchor chains 68 on securing means 71 are reacted by securing means 71 on turret 32. A significant portion of the horizontal force exerted by anchor chains 68 is applied to the lower end portion or fender 40 of turret 32 at curved surface 80 below the docked position of spider buoy 44. Thus, except for a very small lateral load reacted by guide tubes 72, substantially the entire lateral or horizontal load of anchor chains 68 is applied to turret 32 below spider buoy 44.

While the preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A disconnectable vessel mooring system including a vessel in sea water above a sea bed and having a hull with a vertical opening therein and a turret mounted within said vertical opening so that the vessel may weathervane about the turret, the vertical opening having sea water therein; the improvement comprising:

a downwardly opening recess in said turret extending downwardly below the sea water level;

a buoy received within said recess in a docked position with an upper end of said buoy detachably coupled to said turret at a level above said sea water level;

a plurality of mooring lines extending through said buoy to the sea floor for anchoring said turret to the sea floor to permit weathervaning of the vessel about the turret when said buoy is in said docked position within said turret;

guide means on said buoy for permitting relative longitudinal movement of said mooring lines with respect to said buoy; and releasable securing means on said turret to releasably secure the upper ends of said mooring lines to said turret upon docking of said buoy.

2. The detachable vessel mooring system of claim 1 wherein:

said turret has a generally cylindrical housing having an open lower end for forming said recess receiving said buoy and sea water; and said housing having an inwardly extending horizontal platform above water level to support workmen for servicing said upper end of said buoy in said docked position within a dry area of said housing.

3. A detachable vessel mooring system of claim 1 wherein:

a plurality of risers supported by said buoy extend from the sea floor; and product lines on said turret are coupled to said risers on said buoy at a position above said sea water level in said docked position for the transport of product to storage areas of said vessel.

4. The detachable vessel mooring system of claim 1 wherein:

said turret has an arcuate lower end portion;

said mooring lines in said docked position of said buoy arranged and designed for engaging said arcuate lower end portion; wherein the mooring forces exerted by said mooring lines secured to said turret are transferred to said turret while substantially bypassing said buoy in the docked position of said buoy.

5. The detachable vessel mooring system of claim 1 further comprising:

a retrieval line secured to said buoy; and power means on said turret for pulling said retrieval line and said buoy into docked position for detachable coupling to said turret.

6. A disconnectable vessel mooring system comprising:

a vessel having a hull with a vertical opening therein;

a turret rotationally carried by said vessel within said vertical opening;

a spider buoy arranged for detachable coupling to said turret;

a plurality of mooring lines extending from said buoy to a sea floor which anchor the buoy and turret to permit weathervaning of the vessel about the turret;

mooring line guide means on said buoy for permitting longitudinal movement of at least some of said mooring lines relative to said buoy; and mooring line anchoring means on said turret to engage and releasably secure the upper ends of said mooring lines to said turret for docking of said buoy.

7. The disconnectable vessel mooring system of claim 6 wherein:

said mooring line guide means includes a plurality of tubular members secured to the outer surface of said buoy for receiving said mooring lines;

said mooring lines movable longitudinally relative to said tubular members upon securing of said mooring lines to said turret and docking of said buoy.

8. The disconnectable vessel mooring system of claim 7 wherein:

leader lines are attached to the upper ends of selected mooring lines; and releasable means are provided for releasing said selected mooring lines from said buoy to permit lowering of said selected mooring lines onto the sea floor by said leader lines.

9. The disconnectable vessel mooring system of claim 6 wherein:

said turret has a lower arcuate surface for engaging said mooring lines in said docked position of said buoy with the upper ends of said mooring lines being secured to said turret; the anchoring forces from said mooring lines being transferred to said turret while substantially bypassing said buoy in the docking position of said buoy.

10. The disconnectable vessel mooring system of claim 9 wherein:

said turret has an open lower end portion defining a recess therein; and said buoy is received within said recess in the docked position of said buoy with the upper end portion of said buoy positioned at a level above a sea water level within the recess to permit dry access to said buoy.

11. The disconnectable vessel mooring system of claim 10 wherein:

said turret includes a generally cylindrical housing having an open lower end defining said recess; said housing having an inwardly extending horizontal platform above the sea water level to support workmen for servicing said buoy in docked position within said housing;

a plurality of risers extend from said buoy to said sea floor; and product conduit lines from said turret are coupled to said risers at a position above said sea water level on said buoy for the transport of product from subsea wells to storage areas of said vessel.

* * * * *